US005403634A

United States Patent [19]

Mauffette

[11] Patent Number: 5,403,634

[45] Date of Patent: Apr. 4, 1995

[54] COLLAPSIBLE FLOWER VASE

[75] Inventor: Claude . Mauffette, Montréal, Canada

[73] Assignee: Lumigem Canada Inc., Montreal, Canada

[21] Appl. No.: 155,417

[22] Filed: Nov. 16, 1993

[51] Int. Cl.[6] ..... A47G 7/00; B65D 85/50

[52] U.S. Cl. ..... 428/34.3; 428/35.2; 428/36.9; 428/36.91; 428/192; 206/423; 220/402; 220/403; 220/404; 47/41.01; 47/41.13; 47/41.15; 47/72

[58] Field of Search ..... 428/34.3, 36.9, 36.92, 428/36.91, 192, 35.2, 23; 47/41.01–41.15, 72; 206/423; 220/402, 403, 404

[56] References Cited

U.S. PATENT DOCUMENTS

| | | | |
|---|---|---|---|
| 2,780,402 | 2/1957 | Tucker et al. | 220/404 |
| 2,898,705 | 8/1959 | Carlson | 47/41.1 |
| 3,127,011 | 3/1964 | Weddle | 206/423 |
| 3,484,017 | 12/1969 | O'Donnell | 220/403 |
| 3,899,100 | 8/1975 | Rigaud | 47/41.11 |
| 3,973,356 | 8/1976 | Schacht | 47/41.01 |
| 4,696,840 | 9/1987 | McCullough | 428/34.3 |
| 4,919,981 | 4/1990 | Levey et al. | 428/34.1 |
| 4,936,046 | 6/1990 | Miller | 47/41.01 |

*Primary Examiner*—Ellis P. Robinson
*Assistant Examiner*—Rena L. Dye
*Attorney, Agent, or Firm*—Helfgott & Karas

[57] ABSTRACT

The disclosure herein describes a collapsible flower vase that includes an elongated sleeve member made of flexible material, a pair of collars having a given shape, each having a structure adapted to engage a corresponding edge of the sleeve member to form a rigid assembly having a shape corresponding to that of the collars, and a flexible water-tight bag received within the rigid assembly and secured between one of the collars and an edge of the sleeve member. The sleeve member has rigidity along its longitudinal axis and flexibility in a direction perpendicular to the longitudinal axis.

8 Claims, 2 Drawing Sheets

COLLAPSIBLE FLOWER VASE

FIELD OF THE INVENTION

The present invention pertains to a flower vase made of various components which may be assembled and disassembled.

BACKGROUND OF THE INVENTION

There is some need to provide a simple device which may be so assembled as to form rapidly a vase to receive flowers, plants or the like, including water or soil.

One advantage of such vase is that, when in a non-assembled condition, the various parts may be neatly packed within a small recipient which can be sold at the same time flowers are bought.

SUMMARY OF THE INVENTION

The present invention therefore relates to a collapsible flower vase which comprises, in combination, an elongated sleeve member made of a material which is stiff along its longitudinal axis, but flexible in a direction perpendicular to the said axis; a pair of collars having a given shape and being made of rigid material, each collar including means engaging a corresponding one of the upper or lower edges of the sleeve member to form a rigid assembly having a shape corresponding to that of the collars, and a flexible water-tight bag received within the rigid assembly, the bag being retained at its open end between one of the collars and the upper edge of the sleeve member.

Hence, flowers or plants may be received within the assembled vase with water and/or soil.

In one form of the invention, both collars are identically constructed.

In another form of the invention, the sleeve member is formed of a transparent plastic material so that a display sheet can be seen and retained within the assembly between the bag and one of the side walls of the sleeve member.

Further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
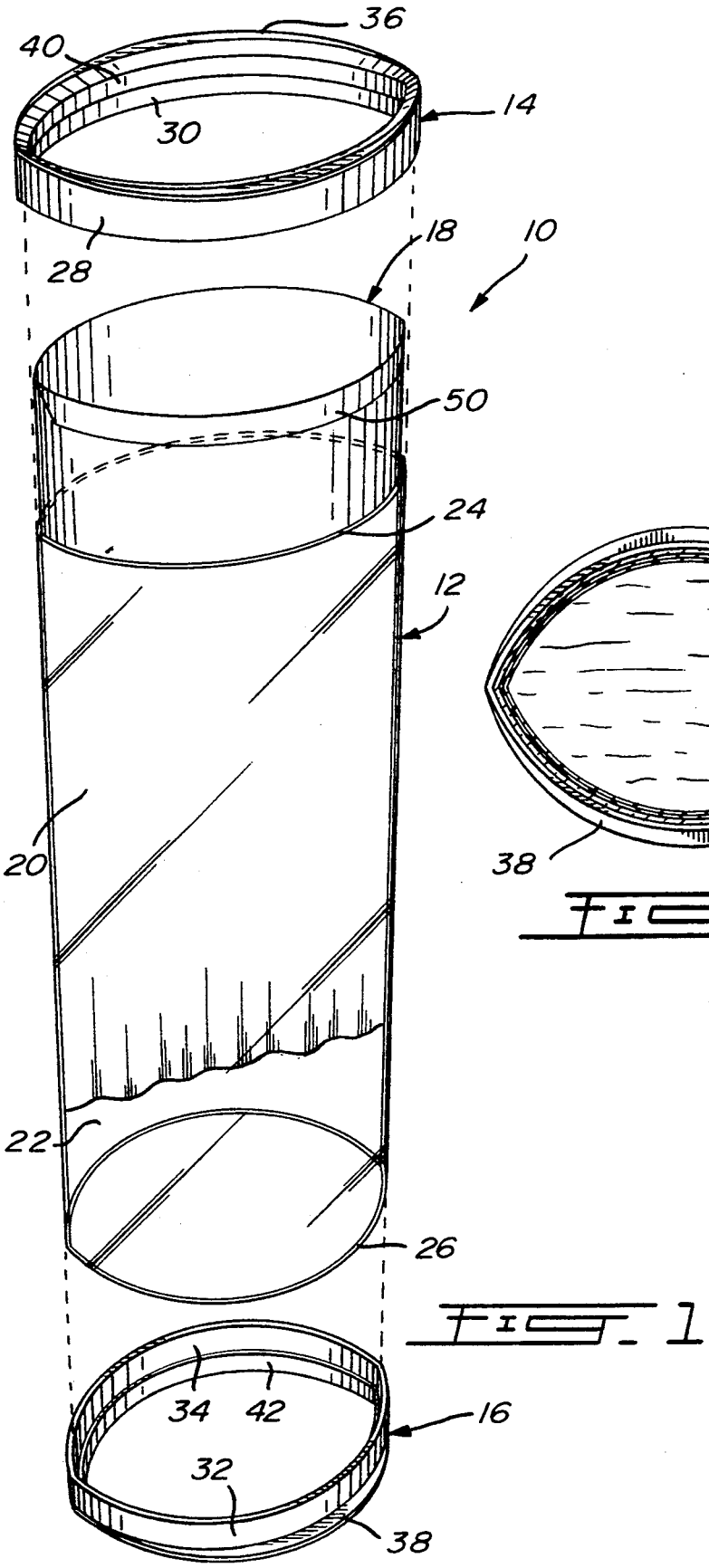
FIG. 1 is a top perspective exploded view of a collapsible flower vase made in accordance with the present invention.

Referring to FIG. 1, the collapsible vase of the present invention, generally denoted 10, comprises the combination of an elongated sleeve member 12, a pair of collars 14 and 16 and a water-tight bag 18.

Figure 3:
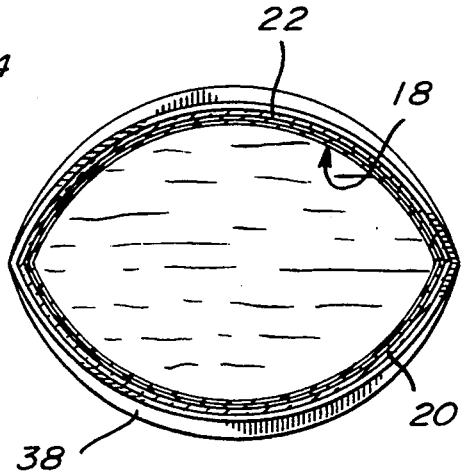
FIG. 3 is a cross-sectional view taken along lines 3—3 of FIG. 2.
Figure 2:
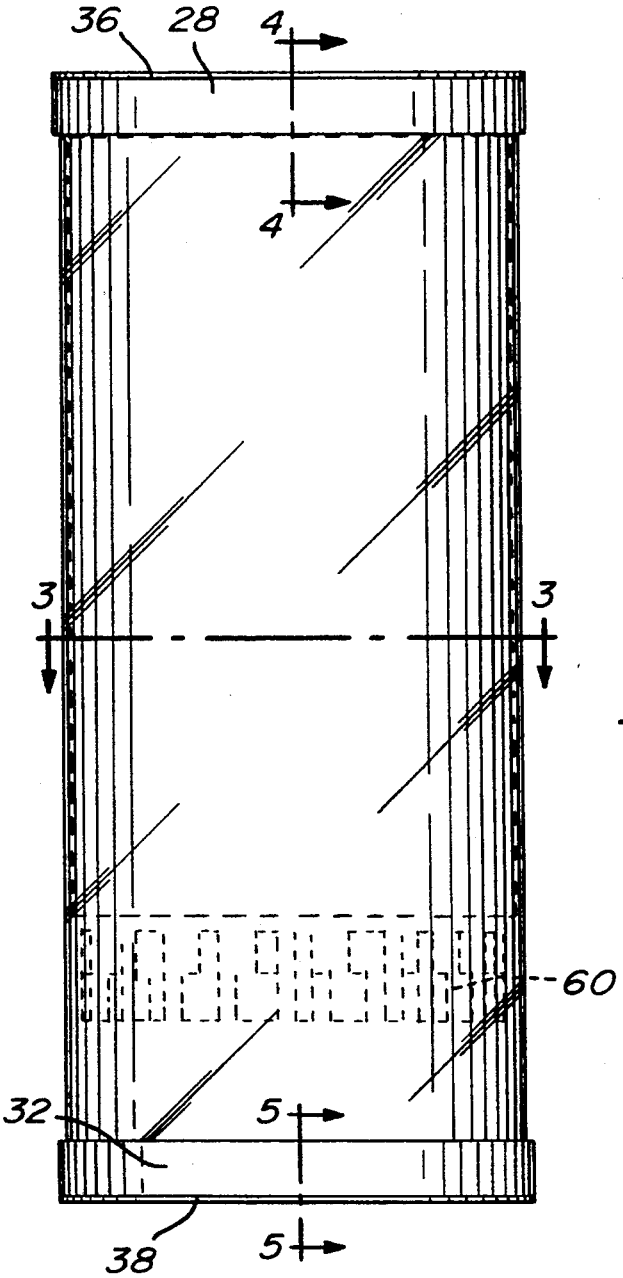
FIG. 2 is a side elevation thereof with a display sheet therein.

Referring also to FIGS. 2 and 3, the elongated sleeve member 12 has a oval-shape with opposite side walls 20 and 22 terminating at an upper edge 24 and a lower edge 26. The sleeve member 12 is made of a flexible material having a stiffness, however, in its longitudinal axis. The flexibility allows it, when in a non-assembled condition, to be pressed so that the two side walls 20 and 22 may be brought close to one another while its rigidity allows it to form a rigid assembly when in the assembled condition such as shown in FIG. 2. One material preferred is a plastic such as PVC; however, a flexible metal material such as aluminum could be used as well as cardboard.

The two collars in the embodiment illustrated are identically structured. They are made of a rigid material, preferably plastic. They each include opposite side walls 28, 30 and 32, 34, respectively, defining an oval-shape and a flat peripheral portion 36, 38. Each side wall of the collars has an inner short wall 40, 42 in close proximity with their respective oval side walls to define a peripheral groove in which may be frictionally engaged the respective one of edges 24, 26 of the sleeve member.

The water-tight flexible bag 18 has a dimension as to fit into the sleeve member 12. One method of mounting the bag to the rigid assembly is to have its upper edge folded, such as shown at 50, so that it may be hung to the upper edge 24 of the sleeve member. Its securement into place is accomplished by collar 14 (see FIG. 4) where the upper edge of the sleeve member with the folded portion of the bag is received in the groove formed between the walls 28 and 40 of the collar. Then, the lower edge 26 of the sleeve member (see FIG. 5) is inserted into the groove 37 of the lower collar 16 to thereby form a rigid assembly which may be supported vertically due to the presence of the flat base 38 of the collar.

Figure 4:
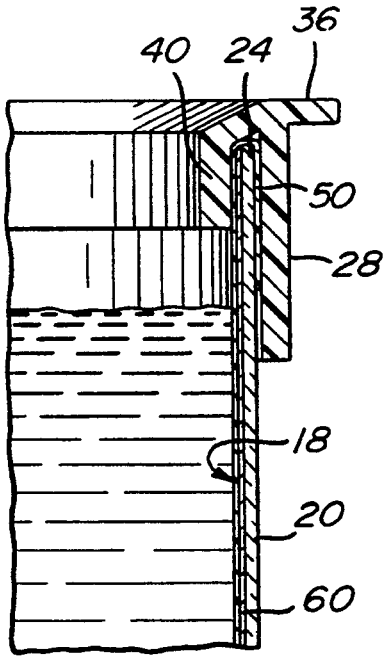
FIG. 4 is an enlarged cross-sectional view taken along lines 4—4 of FIG. 2.
Figure 5:
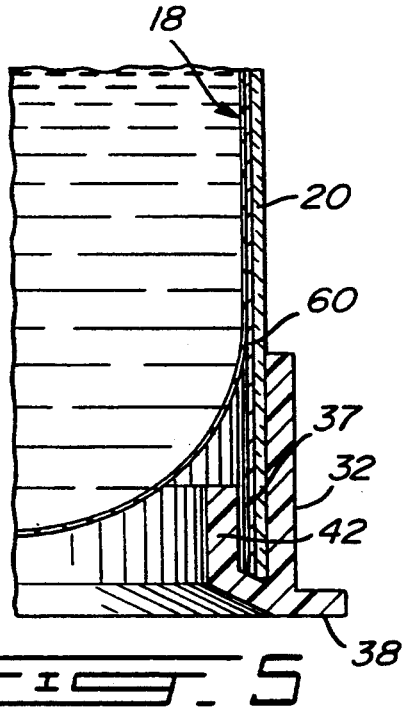
FIG. 5 is an enlarged cross-sectional view taken along lines 5—5 of FIG. 2.

In another form of the invention, the flexible plastic material of the sleeve member is preferably transparent so that a display sheet, such as 60 in FIGS. 2, 4 and 5, may be inserted into the assembled vase or prior to the mounting of the lower collar. There are various ways of securing this sheet in the assembly: one would be to have the sheet maintained between the bag and the side wall of the sleeve member only by frictional contact while another would be to have a sheet that would extend from the upper collar to the lower collar and be secured in the grooves formed between walls 28, 40 of the upper collar and walls 32, 42 of the lower collar.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A collapsible flower vase comprising in combination:

an elongated sleeve member having opposite upper and lower edges and opposite side walls; said member being made of a material having stiffness along its longitudinal axis and flexibility along an axis perpendicular to said longitudinal axis;

a pair of separate rigid annular collars each having a given shape and being made of rigid material, each of said collars including means for engaging a corresponding one of said edges of said sleeve member so that when said sleeve member is engaged to said engaging means of each of said collars at said upper and lower edges thereof a rigid assembly is formed having a cross-sectional shape corresponding to that of said collars; and a flexible water-tight bag received within said rigid assembly, said bag having an open end with edges engaged between one of said collars and one of said opposite edges of said sleeve member to thereby define a vase for receiving flowers, plants or the like.

2. A collapsible flower vase as defined in claim 1, wherein said rigid assembly defines an oval shape.

3. A collapsible lower vase as defined in claim 1, wherein said collars are identically shaped and made of plastic.

4. A collapsible flower vase as defined in claim 1, wherein said sleeve member is made of transparent plastic material.

5. A collapsible flower vase as defined in claim 4, further comprising a display sheet retained within said sleeve member and being disposed between said bag and one of said side walls.

6. A collapsible flower vase as defined in claim 1, wherein said sleeve member is formed to be collapsible in a direction perpendicular to said longitudinal axis.

7. A collapsible flower vase as defined in claim 1, wherein said engaging means consists of a peripheral groove located internally within each of said collars.

8. A collapsible flower vase as defined in claim 7, wherein each of said collars has, along one edge thereof remote from said groove, a flat portion defining a supporting base for said rigid assembly.

* * * * *